US008783224B2

(12) United States Patent
Jo et al.

(10) Patent No.: US 8,783,224 B2
(45) Date of Patent: Jul. 22, 2014

(54) CRANKSHAFTLESS INTERNAL COMBUSTION ENGINE

(75) Inventors: Wonjin Jo, Hwaseong-si (KR); Hyunjun Hong, Anyang-si (KR); Youngjic Kim, Yongin-si (KR); Kimin Park, Hwaseong-si (KR); Jerok Chun, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 181 days.

(21) Appl. No.: 13/528,408

(22) Filed: Jun. 20, 2012

(65) Prior Publication Data

US 2013/0133625 A1 May 30, 2013

(30) Foreign Application Priority Data

Nov. 30, 2011 (KR) ..... 10-2011-0126697

(51) Int. Cl.
*F02B 75/04* (2006.01)
*F02B 75/32* (2006.01)
*F02D 13/06* (2006.01)

(52) U.S. Cl.
USPC ..... 123/197.1; 123/197.5; 123/48 B; 123/198 E; 123/78 E

(58) Field of Classification Search
CPC ..... F02B 71/00; F02B 75/32; F02B 3/06; F02B 75/246; F02B 75/045; F16H 29/04; F01B 9/047; F01B 2009/045; F01B 15/02; F01B 9/042; F02D 15/02
USPC ..... 123/197.1, 197.5, 198 F, 48 B, 78 E, 78 F
See application file for complete search history.

(56) References Cited

U.S. PATENT DOCUMENTS

| | | | | |
|---|---|---|---|---|
| 5,934,243 | A | 8/1999 | Kopystanski | |
| 7,475,666 | B2 * | 1/2009 | Heimbecker | 123/197.1 |
| 2009/0247360 | A1 * | 10/2009 | Ben-Shabat et al. | 477/115 |
| 2010/0294232 | A1 | 11/2010 | Otterstrom | |

FOREIGN PATENT DOCUMENTS

| | | | |
|---|---|---|---|
| DE | 19844200 | A1 | 6/1999 |
| JP | 63-138126 | A | 6/1988 |
| JP | 06-021565 | B2 | 3/1994 |
| JP | 11-159339 | A | 6/1999 |
| JP | 2003-083105 | A | 3/2003 |
| KR | 20-1998-0062771 | U | 11/1998 |
| KR | 10-2008-0098009 | A | 11/2008 |

* cited by examiner

*Primary Examiner* — Lindsay Low
*Assistant Examiner* — Tea Holbrook
(74) *Attorney, Agent, or Firm* — Morgan, Lewis & Bockius LLP

(57) ABSTRACT

Included may be a crankshaftless internal combustion engine, including a power shaft unit in which a transferring path of a power system may be selected depending on a deactivated state and an activated state of a cylinder, a cylinder separator separating a power system of the deactivated cylinder from the power shaft unit by control of an ECU operated by a deactivated cylinder and an activated cylinder, and a compression changing unit varying a compression ratio of the activated cylinder in multistage.

17 Claims, 10 Drawing Sheets

LOW COMPRESSION RATIO

MEDIUM COMPRESSION RATIO

CRANKSHAFTLESS INTERNAL COMBUSTION ENGINE

CROSS-REFERENCE TO RELATED APPLICATIONS

The present application claims priority to Korean Patent Application Number 10-2011-0126697 filed Nov. 30, 2011, the entire contents of which application is incorporated herein for all purposes by this reference.

BACKGROUND OF THE INVENTION

1. Field of the Invention

The present invention relates to an internal combustion engine, and more particularly, to a crankshaftless internal combustion engine capable of remarkably reducing even noxious exhaust gas while remarkably increasing a fuel efficiency improvement rate by transferring a reciprocating movement of a piston depending on a stroke cycle to power train power or accessory power shaftlessly and variably driving a cylinder.

2. Description of Related Art

In general, in an internal combustion engine such as a gasoline engine or a diesel engine, a piston reciprocates depending on a stroke cycle and the reciprocation movement is converted into rotational toque by using a crank shaft that rotates by receiving the reciprocation.

As described above, rotational force of the crank shaft pulls out engine power and transfers the engine power to a power train or is used as power for driving an accessory such as an electronic apparatus, and as a result, the rotational force serves as a most fundamental component in a power system of the internal combustion engine.

However, in the crank shaft, a change in a volume in a combustion chamber to a change in a crank angle around a top dead point in a reciprocating stroke cycle of a piston is small, and as a result, high-pressure and high-temperature combustion gas in the combustion chamber cannot but be spilled or heat-transferred to a wall surface of the piston.

The piston operation consequently reduces combustion efficiency to deteriorate fuel efficiency and increase noxious exhaust gas, and as a result, there is a fundamental limit which is not suitable even for high oil prices and strengthened environmental regulations.

However, improvement of the fuel efficiency and reduction of the noxious exhaust gas should be implemented even in the internal combustion engine due to the high oil prices and the strengthened environmental regulations.

As the example, there is a variable cylinder deactivation engine.

In this case, by changing a cylinder driving scheme in which fuel is excessively consumed more than necessary as all the cylinders are simultaneously driven even though all cylinders need not to be driven at a low output, the improvement of the fuel efficiency and the reduction of the noxious exhaust gas can be achieved without changing a configuration of the internal combustion engine.

In general, the crank shaft is necessarily applied even to the variable cylinder deactivation engine having the above engine control scheme.

As a result, heat cannot but be transferred between the high-pressure and high-temperature combustion gas and the piston due to a change in volume in the combustion chamber which is relatively small than the change in crank angle around the top dead point even in the variable cylinder deactivation engine.

Therefore, when the internal combustion engine implements power transfer without the crank shaft which causes heat transfer through the piston and the resulting deterioration in the fuel efficiency, the fuel efficiency can be prevented from deteriorating due to the crank shaft.

Moreover, when the crankshaftless internal combustion engine is cylinder-controlled by a variable cylinder scheme, the fuel efficiency can be further prevented from deteriorating while an increase in the noxious exhaust gas is suppressed.

Further, as another method for improving the fuel efficiency, a variable compression ratio is controlled.

In this case, the fuel efficiency is improved by increasing a compression ratio of a mixer in a low load condition of an engine, while the engine output is improved as well as knocking is prevented from occurring by reducing the compression ratio of the mixer in a high load condition of the engine.

However, the variable compression ratio control further requires a separate variable compressor mechanism for differentiating the height of the piston.

As described above, the fuel efficiency of the internal combustion engine can be improved in various methods, and as a result, the fuel efficiency is maximally prevented from deteriorating and simultaneously, the noxious exhaust gas is also reduced together, thereby more easily conforming to the high oil prices and the strengthened environmental regulations.

However, an aspect of hardware in which a compression ratio varies simultaneously while the internal combustion engine is configured without the crank shaft and an aspect of software in which the hardware is controlled by the variable cylinder scheme cannot but be complicated due to various factors.

Therefore, the complicated aspects cannot but make it more difficult to commercialize the internal combustion engine capable of controlling the engine by the variable cylinder scheme without the crank shaft.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a crankshaftless internal combustion engine in which the power of the power train or accessory power transfer is implemented crankshaftlessly with the piston which generates the power by the reciprocating movement which depends on the stroke cycle so as to significantly improve deterioration in the fuel efficiency by removing a bad influence depending on rotating movement of the crank shaft and prevent additional deterioration in the fuel efficiency by variably driving the cylinder according to a vehicle driving condition, thereby significantly increasing a total fuel efficiency improvement rate and significantly reducing the noxious exhaust gas.

Further, various aspects of the present invention are directed to providing a crankshaftless internal combustion engine in which a compression ratio of a combustion chamber is changed by a change in the height of a piston for the combustion chamber to further increase fuel efficiency, and as a result, knocking is prevented from occurring to further improve engine output.

In an aspect of the present invention, a crankshaftless internal combustion engine, may include an engine block having a plurality of cylinders each having a reciprocating power system and controlled in a deactivated state and an activated state, a cylinder head including a valve system for exhausting air as well as supplying fuel required in each cylinder, and an oil pan provided below the cylinder head, a power shaft unit converting a power generated from a power system of an activated cylinder into an engine output and transferring the engine output to a transmission without transferring the engine output to a power system of a deactivated cylinder, a cylinder separator controlled by an ECU operating the plurality of cylinders as the deactivated cylinder and the activated cylinder and controlled by the ECU to separate the power system of the deactivated cylinder from the power shaft unit, and a compression changing unit controlled by the ECU so as to vary a compression ratio of the activated cylinder in multistage.

The power systems of the activated and deactivated cylinders may include a piston reciprocating in a combustion chamber of each cylinder so as to form a 4-stroke cycle, a connecting rod connected to the piston and reciprocating together with the piston, wherein the connecting rod may have a thread formed on an outer peripheral surface, and a gear rod having a groove of thread to be engaged with the thread of the connecting rod, wherein the gear rod is engaged to the power shaft unit to rotate the power shaft unit while moving together with the connecting rod.

The gear rod may include a pair of first and second fixation bosses formed at both sides thereof, and first and second intergears rotatably coupled to the first and second fixation bosses respectively, wherein the first and second intergears are meshed with inter gears formed in the engine block, wherein a vertical reciprocating movement of the gear rod is guided by the pair of first and second fixation bosses which engage with the respective first and second intergears that free rotates in the engine block, and wherein a gear is formed on the gear rod on different portions where the pair of first and second fixation bosses are not formed.

The power shaft unit may include a main power shaft converting a power converted by the gear rod moving together with the connecting rod of the activated cylinder into the engine output transferred to the transmission, and a sub power shaft preventing the power of the main power shaft from being transferred to the gear rod moving together with the connecting rod of the deactivated cylinder in association with the cylinder separator, while transferring the power converted by using the gear rod moving together with the connecting rod of the activated cylinder to the main power shaft.

The main power shaft and the sub power shaft are arranged perpendicularly to the connecting rod and a rotation of the main power shaft or the sub power shaft is generated in a unidirectional stroke of the connecting rod in a reciprocating stroke thereof.

The power shaft unit may include first semi gears formed to the main power shaft and second semi gears formed to the sub power shaft, the first and second semi gears being alternatively engaged with a gear of the gear rod.

The first and second semi gears may have half portion thereof formed with a plurality of gear tooth and rotate with the same phase angle.

A switching gear is engaged to both an input gear connected to the sub power shaft and an output gear connected to the main power shaft.

The main power shaft may have a flywheel at a connection portion of the transmission and an accessory configured by a timing gear together with a driving pulley of an electronic apparatus at an opposite side to the connection portion of the transmission.

The cylinder separator may include a moving fork of which a direction is switched according to a switching power unit having a relay switched by control by the ECU, and a moving gear slidably mounted on the sub power shaft and engaged to the moving fork so as to move on the sub power shaft according to an operation of the moving fork, wherein at least one of the second semi gears are mounted to the moving gear, and wherein the moving gear adds the engine output to the main power shaft of the power shaft unit transferring the engine output to the transmission, and wherein according to the operation of the moving fork, the moving fork moves the at least one second semi gear along the sub power shaft.

A pair of moving gears is configured to move at least two semi gears by one-time movement of a pair of moving forks.

The moving fork may have a fork structure engaged with the at least one second semi gear and the moving gear to which the at least one second semi gear is mounted is a hub including a protruding portion that engages with the moving fork.

A pair of hubs is configured to move at least two semi gears by one-time movement and a pair of moving forks are configured to move the pair of hubs.

The hub is spline-coupled to the sub power shaft to move the at least one second semi gear.

The compression changing unit may include a switching power unit having a relay switched by control of the ECU, a rack bar engaged to the switching power unit and linearly moving by a switching operation of the switching power unit, and a pinion fixed to the connecting rod and engaged to the rack bar, wherein the piston moves vertically while the pinion rotates the connecting rod by linear movement of the rack bar as to move the gear rod to vary a relative distance between the power shaft unit and the piston.

The pinion is integrally provided at an end portion of the connecting rod.

The compression changing unit is installed in the oil pan.

As set forth above, according to an exemplary embodiment of the present invention, deterioration in fuel efficiency may be significantly improved as a bad influence is removed depending on rotating movement of a crank shaft without the crank shaft while using a reciprocating movement of a piston of an internal combustion engine, the deterioration in the fuel efficiency may be further improved due to variable driving of a cylinder according to a vehicle driving condition, and a total fuel efficiency improvement rate of an engine may be significantly increased due to improvement of maximized fuel efficiency deterioration.

Further, a small volume change in a volume of a combustion chamber which is a bad influence due to a change in a crank angle at top dead points of the crank shaft and heat transfer of the piston depending on high temperature and high pressure may be fundamentally prevented to significantly reduce noxious exhaust gas due to an increased Nox generation suppressing rate, and particularly, a fuel efficiency improvement rate may be further increased by preventing heat-transfer loss.

In addition, a compression ratio of a combustion chamber is changed by a change in the height of a piston for the combustion chamber while transferring power without the crank shaft to further increase fuel efficiency, and particularly, knocking is prevented from occurring to further improve engine output.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1A:
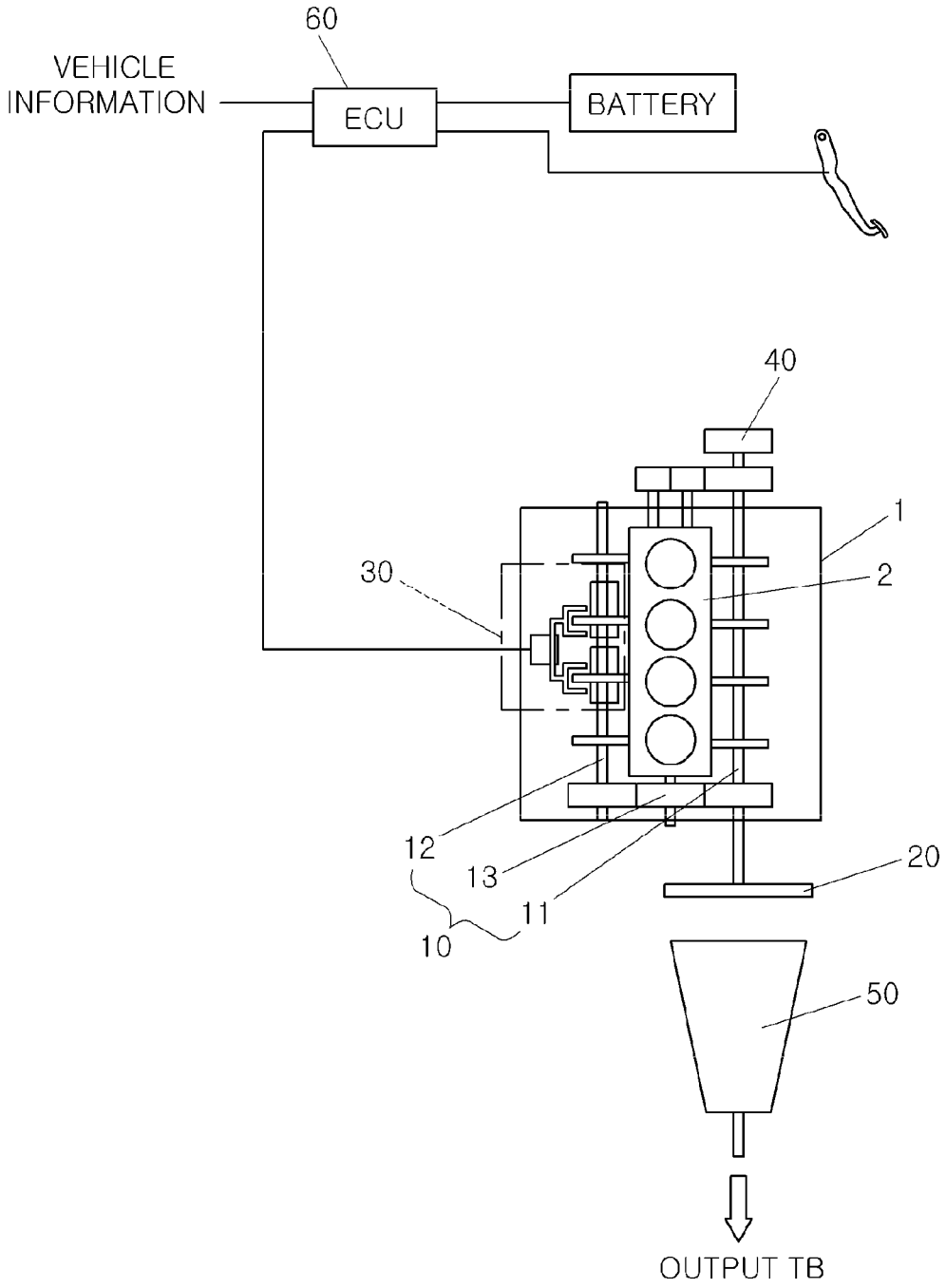
FIG. 1A is a configuration diagram of a crank shiftless internal combustion engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will be hereinafter described in detail with reference to the accompanying drawings.

Figure 1B:
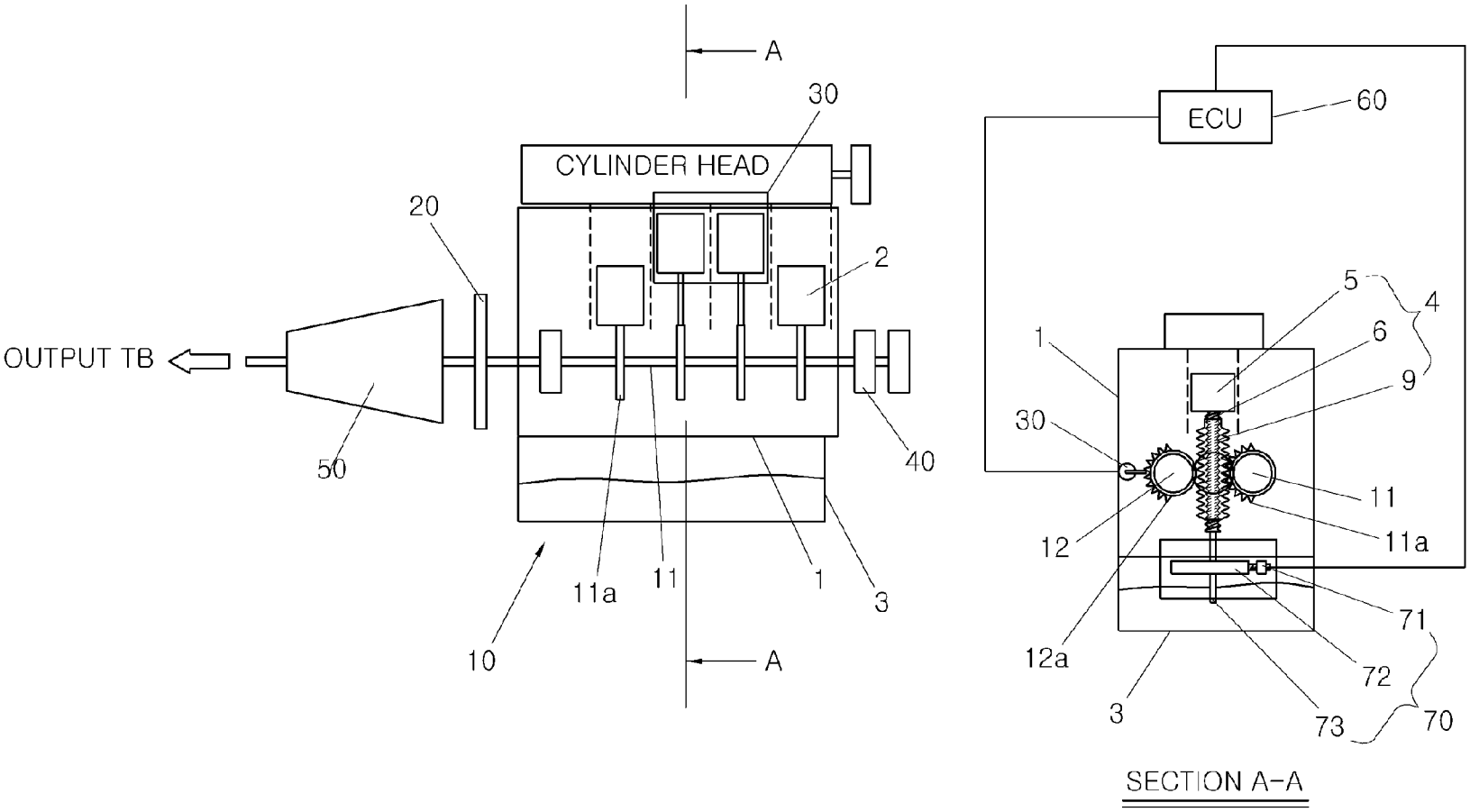
FIG. 1B is a configuration diagram of a crank shiftless internal combustion engine according to an exemplary embodiment of the present invention.

Referring to FIG. 1, a crankshaftless internal combustion engine includes an engine block 1 having a cylinder 2 constituted by at least 4 cylinders or more, a power shaft unit 10 receiving power generated by driving the cylinder 2 and converting the received power into an engine output, a cylinder separator 30 disconnecting some deactivated cylinders among cylinders of the cylinder 2 or connecting some activated cylinders, a transmission 50 receiving output torque of the output shaft unit 10, an ECU 60 processing various vehicle information including an acceleration pedal and controlling the cylinder separator 30 according to the cylinders in the deactivated state and the activated state, and a compression changing unit 70 controlled by the ECU 60 so as to vary a compression ratio of the activated cylinder 2 in multistage.

Engine block 1 further includes a cylinder head including a valve system for fuel supplying and combustion exhaustion for each cylinder of cylinder 2.

A power system is provided in cylinder 2 and the power system is configured by a piston unit 4 that reciprocates a combustion chamber to form a 4-stroke cycle and is associated with compression changing unit 70 when the compression ratio varies.

Power shaft unit 10 includes a main power shaft 11 converting power converted from a power system of the activated cylinder of cylinder 2 into the engine output transferred to transmission 50 and a sub power shaft 12 applying the power converted from the power system of the activated cylinder to main power shaft 11 as well as being associated with cylinder separator 30 so as to interrupt the power of main power shaft 11 transferred from the power system of the deactivated cylinder of cylinder 2.

Main power shaft 11 and sub power shaft 12 are connected to a reduction gear 13 constituted by a plurality of gears.

A flywheel 20 is coupled to main power shaft 11 side connected to transmission 50, while an accessory 40 is coupled to an opposite side to flywheel 20.

A timing gear is provided in accessory 40 together with a pulley for driving an electronic apparatus.

ECU 60 includes a cylinder control logic that makes each cylinder of cylinder 2 in the activated state or the deactivated state and performs the resulting control and the cylinder control logic may be applied in the same manner as a control logic implemented in a variable cylinder engine.

A compression ratio varying logic capable of varying the compression ratio of the combustion chamber of the activated cylinder is further implemented in the ECU 60.

Figure 2:
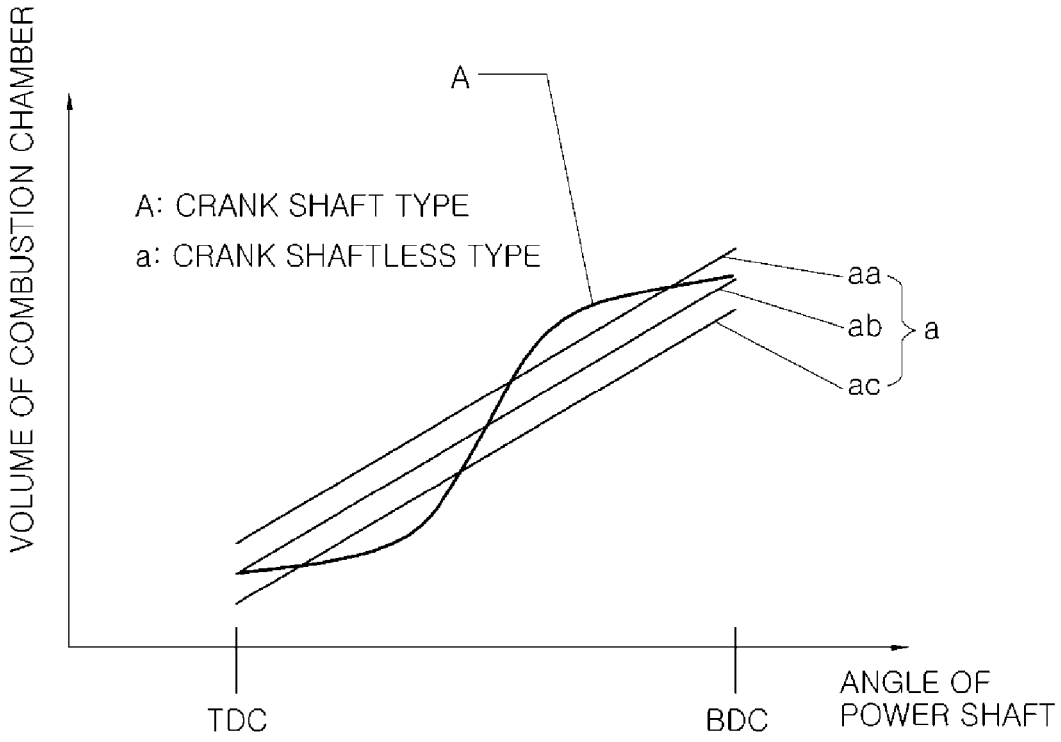
FIG. 2 is a diagram showing a change in volume of a combustion chamber when a stroke of the crankshaftless internal combustion engine according to the exemplary embodiment of the present invention is changed.

Referring to FIG. 2, a line A represents a change in volume of a cylinder chamber by a piston in a power system having a crank shaft, while a line a represents the change in volume of the combustion chamber by the piston when a variable compression ratio is implemented in a power system having main power shaft 11 and sub power shaft 12 without the crank shaft, as in the present exemplary embodiment.

Between a TDC and a BDC which are angle changes of the main power shaft (alternatively, crankshaft) depending on the stroke cycle, it can be seen that the line A causes the change in volume of the combustion chamber, while the line a uniformly maintains the change in volume of the combustion chamber.

In particular, even though the compression ratio of the combustion chamber varies as in variable compression ratio lines aa, ab, and ac, the change in volume of the combustion chamber may be uniformly maintained.

In the case of the line a, fuel efficiency is improved as a holding time of high-temperature and high-pressure states in the combustion chamber is shortened to increase thermal efficiency, and as a result, the fuel efficiency is improved and further, Nox generally generated in the high-temperature state even in exhaust gas is decreased.

In particular, the advantage of the line a is implemented in the engine according to the exemplary embodiment and the engine is controlled in the variable cylinder scheme to be described below, thereby making it possible to further improve the fuel efficiency and to be optimal to even EM improvement.

The engine of the exemplary embodiment has the same advantage as the lines aa, ab, and ac even in the variable compression ratio and the engine is controlled by the compression ratio varying scheme to be described below to further improve the fuel efficiency.

Figure 3:
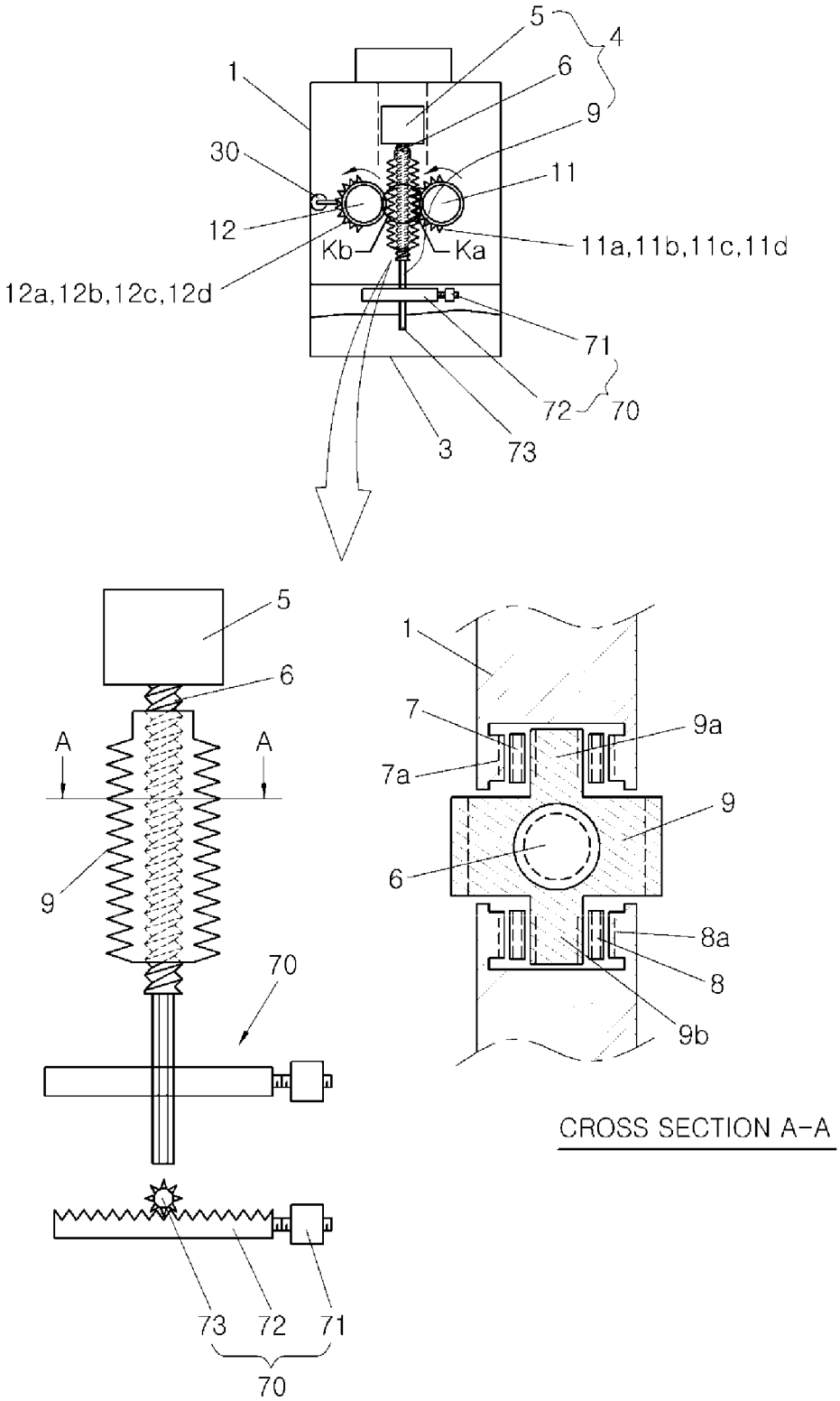
FIG. 3 is a diagram showing a detailed configuration of a cylinder power system of an engine block of FIG. 1.

Referring to FIG. 3, an oil pan 3 containing oil is installed in a lower part of engine block 1 and a piston unit 4 configuring the power system of cylinder 2 is provided in engine block 1.

The piston unit 4 includes a piston 5 in which a 4-stroke cycle is formed through reciprocating movement, a connecting rod 6 reciprocating vertically by receiving the movement of piston 5 and having a thread formed on an outer peripheral surface, a gear rod 9 having a groove of thread formed coupled to connecting rod 6 to move together while covering connecting rod 6, a moving guider guiding vertical reciprocation of gear rod 9, and a transfer converting the vertical reciprocation of gear rod 9 into the engine output.

Referring to a cross section A-A of FIG. 3, the moving guider includes a pair of first and second fixation bosses 9*a* and 9*b* that protrude on both sides on gear rod 9 moving together with connecting rod 6 and a pair of first and second intergears 7 and 8 installed in engine block 1 to be freely rotated.

First fixation boss 9*a* is fixed to first intergear 7 and second fixation boss 9*b* is fixed to second intergear 8, and the pair of first and second intergears 7 and 8 engage with internal gears 7*a* and 8*a* dug in engine block 1, respectively.

The transfer is configured by a gear formed as an outer peripheral surface of gear rod 9 coupled with connecting rod 6 and power shaft unit 10 engages with gear rod 9.

Therefore, the vertical reciprocating movement of gear rod 9 moving together with connecting rod 6 is converted into the rotational torque of power shaft unit 10 and the rotational torque of power shaft unit 10 is provided as engine output Tb.

Main power shaft 11 of power shaft unit 10 includes semi gears 11*a*, 11*b*, 11*c*, and 11*d*, sub power shaft 12 of power shaft unit 10 includes semi gears 12*a*, 12*b*, 12*c*, and 12*d*, and the number of semi gears 11*a*, 11*b*, 11*c*, 11*d*, 12*a*, 12*b*, 12*c*, and 12*d* coincides with the number of cylinder 2.

In power shaft unit 10, main power shaft 11 engages with the gear at one side of connecting rod 6 and sub power shaft 12 engages with the gear at the opposite side thereto.

Therefore, layouts of main power shaft 11 and sub power shaft 12 are symmetric to each other around connecting rod 6.

The pair of first and second fixation bosses 9*a* and 9*b* constituting the moving guider are opposed to each other, and as a result, gear rod 9 moving with connecting rod 6 has a "+" cross-sectional shape.

As a result, the gear formed on gear rod 9 to configure the transfer is formed by two different portions where first and second fixation bosses 9*a* and 9*b* are not formed and the two different portions are opposed to each other.

Meanwhile, compression changing unit 70 includes a switching power unit 71 having a relay switched by control of ECU 60 in compression ratio varying control of ECU 60, a rack bar 72 linearly moving horizontally by switching power unit 71, and a pinion 73 moving the gear rod 9 vertically along the connecting rod 6 by a moving direction of rack bar 72 while engaging with rack bar 72 to vary upper and lower positions of the combustion chamber formed by piston 5.

Compression changing unit 70 is installed in oil pan 3, but as necessary, compression changing unit 70 may be installed outside oil pan 3.

Pinion 73 is formed at an end portion of connecting rod 6 that elongates so as not to be coupled with gear rod 9 and piston 5 is coupled to connecting rod 6.

Switching power unit 71 and rack bar 72 have a power means such as a motor and a ball screw for converting rotational force of the motor into linear movement, but various means capable of implementing the linear movement of rack bar 72 may be actually adopted.

Figure 4:
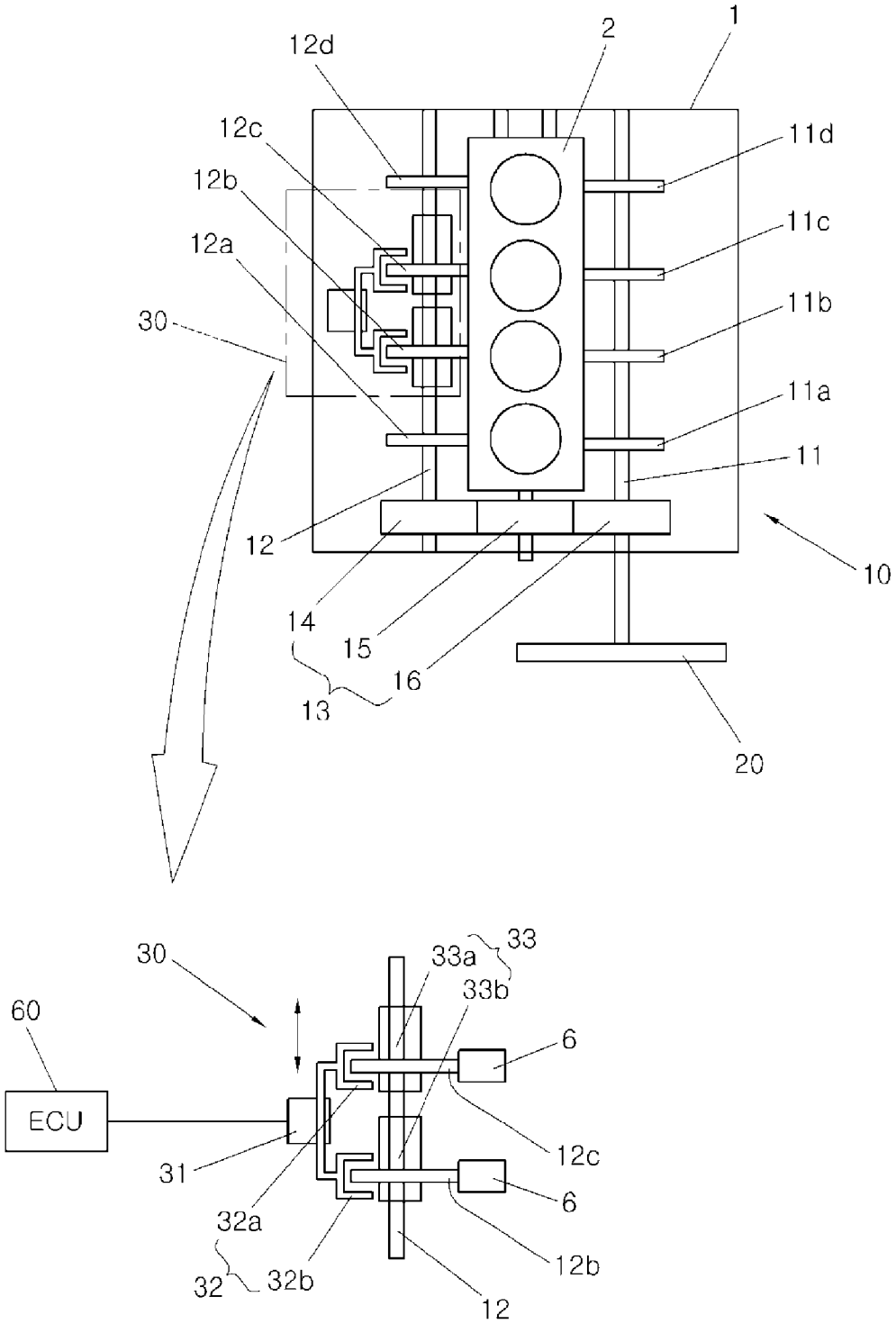
FIG. 4 is a diagram showing a detailed configuration of a power shaft unit and a cylinder separator of FIG. 1.

Meanwhile, referring to FIG. 4, power shaft unit 10 forms a layout in which main power shaft 11 is disposed at one side of cylinder 2 and sub power shaft 12 is disposed at an opposite side thereto, and main power shaft 11 and sub power shaft 12 are connected to reduction gear 13 constituted by the plurality of gears.

The plurality of semi gears in which the gear is formed at an only half portion of a diameter thereof to engage (Ka) with the gear of gear rod 9 are provided on main power shaft 11 and the semi gears are constituted by 4 semi gears 11*a*, 11*b*, 11*c*, and 11*d* to match 4 cylinders of cylinder 2.

The plurality of semi gears in which the gear is formed at an only half portion of a diameter thereof to engage (Kb) with the gear of gear rod 9 are provided on sub power shaft 12 and the semi gears are constituted by 4 semi gears 12*a*, 12*b*, 12*c*, and 12*d* to match 4 cylinders of cylinder 2.

Gear rod 9 moves together with connecting rod 6.

Reduction gear 13 is constituted by an input gear 14 connected to sub power shaft 12 to rotate directly through sub power shaft 12, an output gear 16 connected to main power shaft 11 to apply the rotational force of sub power shaft 12 to main power shaft 11, and a switching gear 15 that engages with input gear 14 and engages with output gear 16.

Input gear 14, switching gear 15, and output gear 16 engage with each other linearly to form a layout arranged linearly.

A gear ratio of input gear 14, switching gear 15, and output gear 16 is variously determined depending on an engine specification.

Cylinder separator 30 is constituted by a switching power unit 31 having a relay switched by the control of ECU 50, a moving fork 32 of which bidirectional movements are changed depending on a switching direction of switching power unit 31, and a moving gear 33 that engages with moving fork 32 to move together in a movement direction of moving fork 32.

Moving fork 32 is constituted by a pair of first and second forks 32*a* and 32*b* that move together in the same direction as the switching direction of switching power unit 31.

A power means that is driven with a power supply which is electrically conducted when switching power unit 31 is switched to move moving fork 32 may be provided between moving fork 32 and switching power unit 31.

The power means is constituted by a motor and a ball screw for converting rotational force of the motor into linear movement or may adopt a means such as a clutch that moves moving fork 32 with the power supply which is electrically conducted when switching power unit 31 is switched.

Moving gear 33 is also constituted by a pair of first and second hubs 33*a* and 33*b*.

First and second hubs 33*a* and 33*b* engage with first and second forks 32*a* and 32*b* of moving fork 32, respectively, and to this end, protruding portions that are coupled with fork structures of first and second forks 32*a* and 32*b* to receive force are formed at first and second hubs 33*a* and 33*b*.

First and second hubs 33*a* and 33*b* move some semi gears among semi gears 12*a*, 12*b*, 12*c*, and 12*d* of sub power shaft 12 in a shaft direction of sub power shaft 12 to serve to separate the semi gears that moves in the movement direction and the deactivated cylinder side from each other.

For example, first and second hubs 33*a* and 33*b* may be configured such that first hub 33*a* moves second semi gear 12*b* which is one of semi gears 12*a*, 12*b*, 12*c*, and 12*d* and second hub 33*b* moves third semi gear 12*c* which is another one among semi gears 12*a*, 12*b*, 12*c*, and 12*d*.

First hub 33*a* and second hub 33*b* determine exact positions of second semi gear 12*b* and third semi gear 12*c* with respect to the corresponding connecting rods, respectively and may serve as positioners through the function.

By this configuration, cylinder separator 30 may separate the power systems of the second cylinder and the third cylinder and a power transferring path of power shaft unit 10 form each other when the second cylinder and the third cylinder among 4 cylinders are at a low output which is a deactivation state and unnecessary waste of the engine output is reduced due to separation of the power transferring path, thereby contributing to improving the fuel efficiency.

Actually, the deactivated cylinder and the activated cylinder for each cylinder of cylinder 2 may be changed appropriately according to the number of the cylinders.

Figure 5:
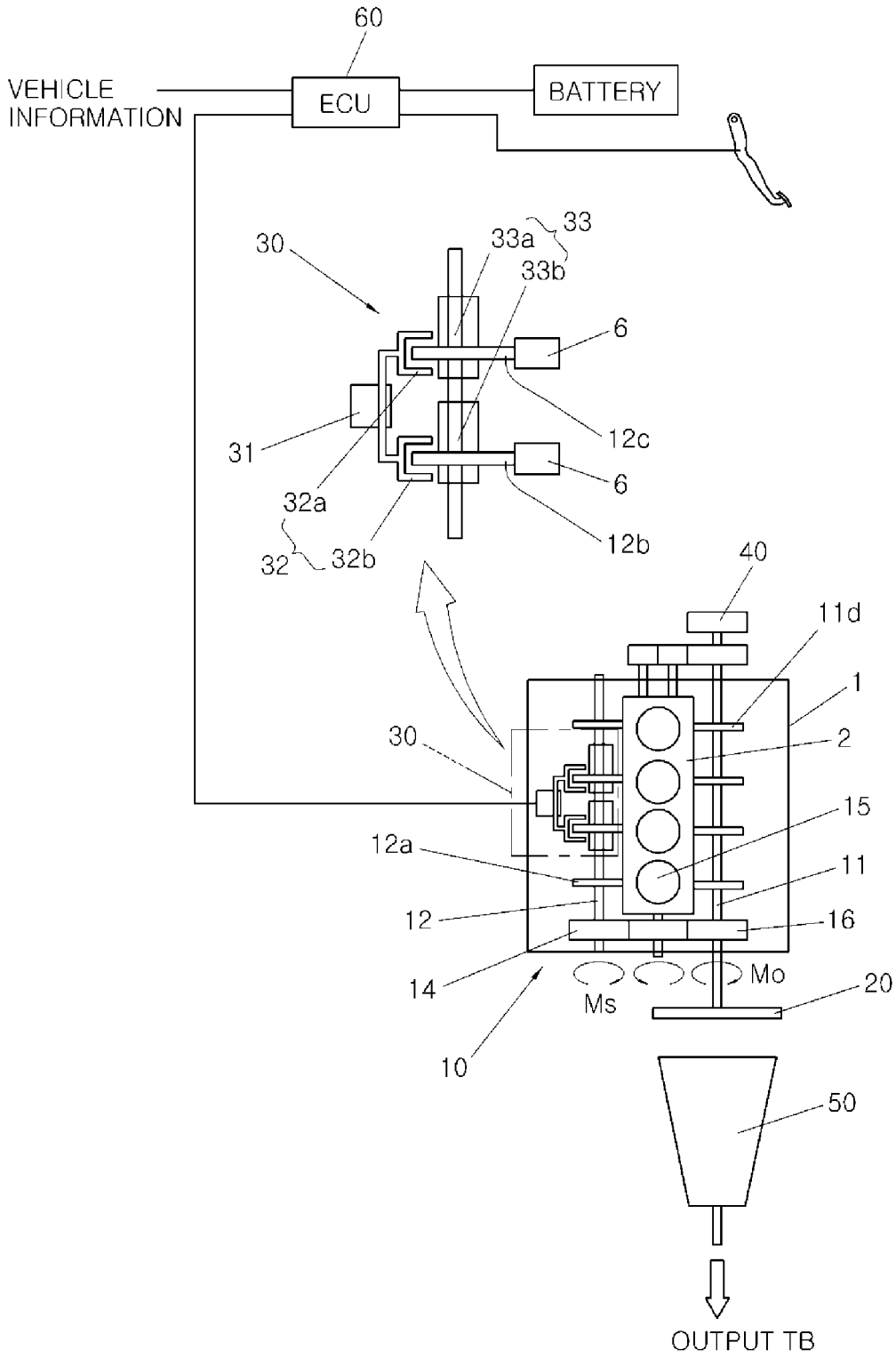
FIG. 5 is a diagram showing a high-output operating state of the crankshaftless internal combustion engine according to the exemplary embodiment of the present invention.

Meanwhile, referring to FIG. 5, in the high-output operation of the engine, all the cylinders of cylinder 2 are simultaneously activated and all the power systems for each cylinder which are being activated and main power shaft 11 and sub power shaft 12 of power shaft unit 10 are connected to each other due to non-operation of cylinder separator 30.

In this state, engine output Tb is generated through the vertical reciprocating movement of connecting rod 6 which occurs together with piston 5 which is the power system for each cylinder and rotations of gear rods 9 moving together with connecting rods 6 of main power shaft 11 and sub power shaft 12 positioned at both sides of connecting rod 6.

As described above, the vertical reciprocating movement of gear rod 9 moving together with connecting rod 6 is stably guided through free rotations of first and second intergears 7 and 8 which engage with first and second fixation bosses 9*a* and 9*b* of gear rod 9.

In this case, although main power shaft 11 and sub power shaft 12 generating engine output Tb are rotated by gear rod 9 which moves vertically together with connecting rod 6, main power shaft 11 and sub power shaft 12 rotate only in one direction.

The reason is because a gear forming section of semi gears 11*a*, 11*b*, 11*c*, and 11*d* of main power shaft 11 and semi gears 12*a*, 12*b*, 12*c*, and 12*d* of sub power shaft 12 is formed according to a downward stroke length of connecting rod 6 which descends together with piston 5 in an explosion stroke.

For example, referring to FIG. 3, when a stroke to drop connecting rod 6 together with piston 5 occurs as the explosion stroke of the cylinder, semi gears 11*a*, 11*b*, 11*c*, and 11*d* of main power shaft 11 and semi gears 12*a*, 12*b*, 12*c*, and 12*d* of sub power shaft 12 engage (Ka and Kb) with the gear of gear rod 9 so that the semi gears rotate.

On the contrary, when a stroke to lift connecting rod 6 together with piston 5 occurs as a suction stroke, semi gears 11*a*, 11*b*, 11*c*, and 11*d* of main power shaft 11 and semi gears 12*a*, 12*b*, 12*c*, and 12*d* of sub power shaft 12 do not engage with the gear of gear rod 9.

Therefore, the engine is in a high-output state when cylinder separator 30 is not operated and engine output Tb is expressed as rotational force Mo of main power shaft 11 receiving rotational force Ms of sub power shaft 12 transferred through reduction gear 13 together.

This means that main power shaft 11 uses the powers of all the activated cylinders as engine output Tb to activate the engine in the high-output state.

Engine output Tb outputted from main power shaft 11 is transferred to transmission 50 and transmission 50 is shifted to an appropriate shift step according to a driver's control or the control of ECU 60, such that a vehicle may be driven in the high-output state.

Figure 6:
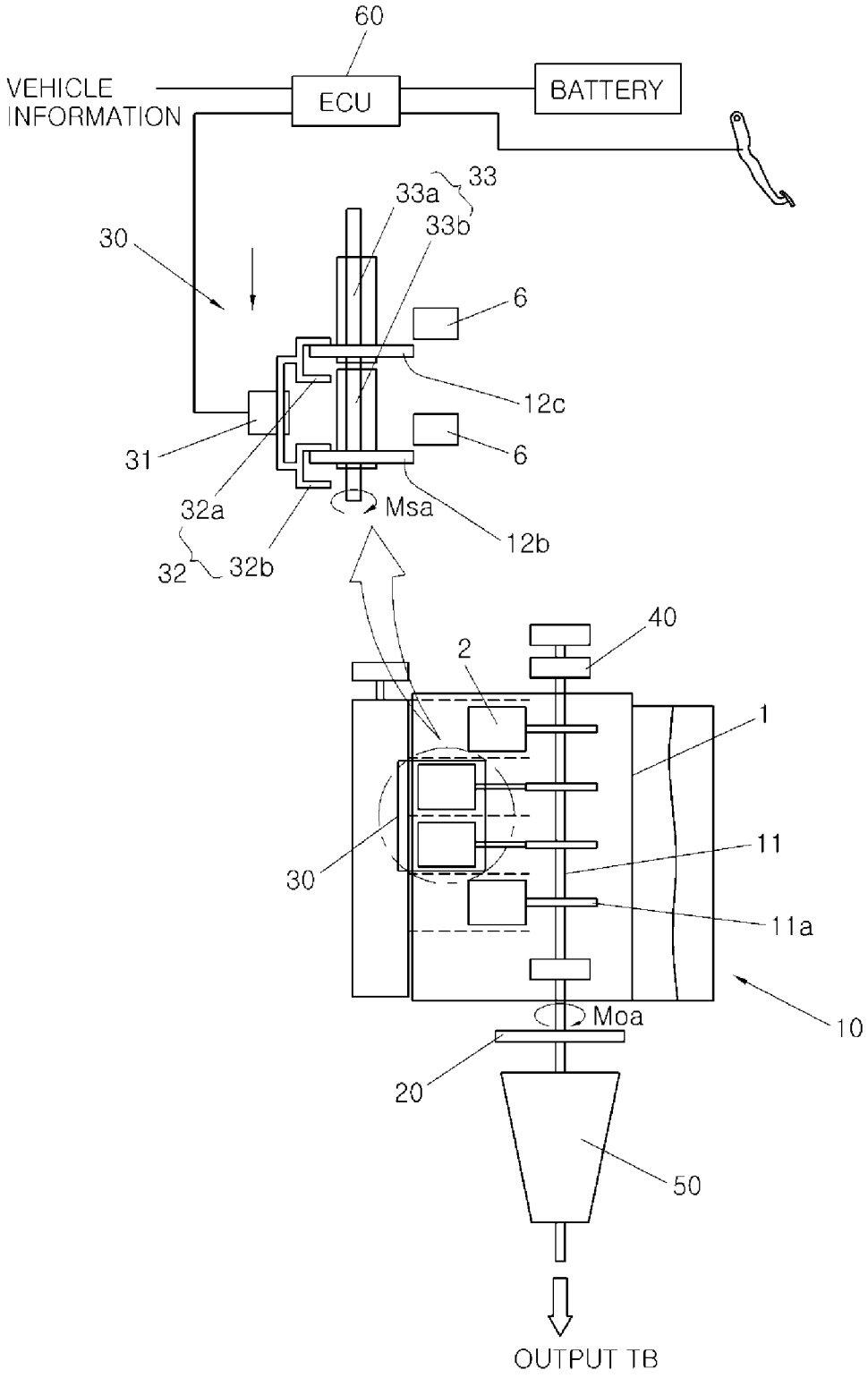
FIG. 6 is a diagram showing a low-output operating state of the crankshaftless internal combustion engine according to the exemplary embodiment of the present invention.

On the contrary, FIG. 6 shows a low-output operating state of the engine. When the engine operates in low output, the first cylinder and the fourth cylinder among the 4 cylinders of cylinder 2 are activated, while the second cylinder and the third cylinder are deactivated.

This is performed by the cylinder control logic of ECU 60.

In this case, cylinder separator 30 is controlled by ECU 60 to separate the power systems of the second cylinder and the third cylinder that are deactivated.

Therefore, the power systems of the first cylinder and the fourth cylinder that are activated and the power transferring path of power shaft unit 10 are connected to each other to be switched to an engine output Ta, while the power systems of the second cylinder and the third cylinder that are deactivated and the power transferring path of power shaft unit 10 are switched to a separated state.

When the power systems of the second cylinder and the third cylinder and the power transferring path of power shaft unit 10 are separated from each other, rotational force of power shaft unit 10 through the first cylinder and the fourth cylinder that are activated is not used to operate the power systems (piston and connecting rod) of the second cylinder and the third cylinder that are deactivated, and as a result, engine output Ta is also prevented from deteriorating to improve the fuel efficiency.

However, when cylinder separator 30 is operated by ECU 60, the pair of first and second forks 32*a* and 32*b* are moved by switching power unit 31 in which power is electrically conducted.

Then, the pair of first and second hubs 33*a* and 33*b* that engage with first and second forks 32*a* and 32*b* are moved together with first and second forks 32*a* and 32*b* by taking a spline of sub power shaft 12, such that second and third semi gears 12*b* and 12*c* of sub power shaft 12 also move.

As a result, second semi gear 12*b* is separated from the connecting rod configuring the power system of the second cylinder and the third semi gear 12*c* is separated from the connecting rod configuring the power system of the third cylinder.

In this state, when ECU 60 operates the pair of first and second forks 32*a* and 32*b* in a reverse direction, the second and third semi gears 12*b* and 12*c* are connected with the connecting rods again.

When the engine is in the low-output state, engine output Ta is generated by rotational force Moa of main power shaft 11 receiving rotational force Msa of sub power shaft 12 transferred through reduction gear 13 together.

When the engine is in the low-output state, efficiency in which rotational force Moa of main power shaft 11 is used as engine output Tb is significantly increased, and as a result, engine output Ta is prevented from deteriorating and the fuel efficiency can be improved.

Figure 7A:
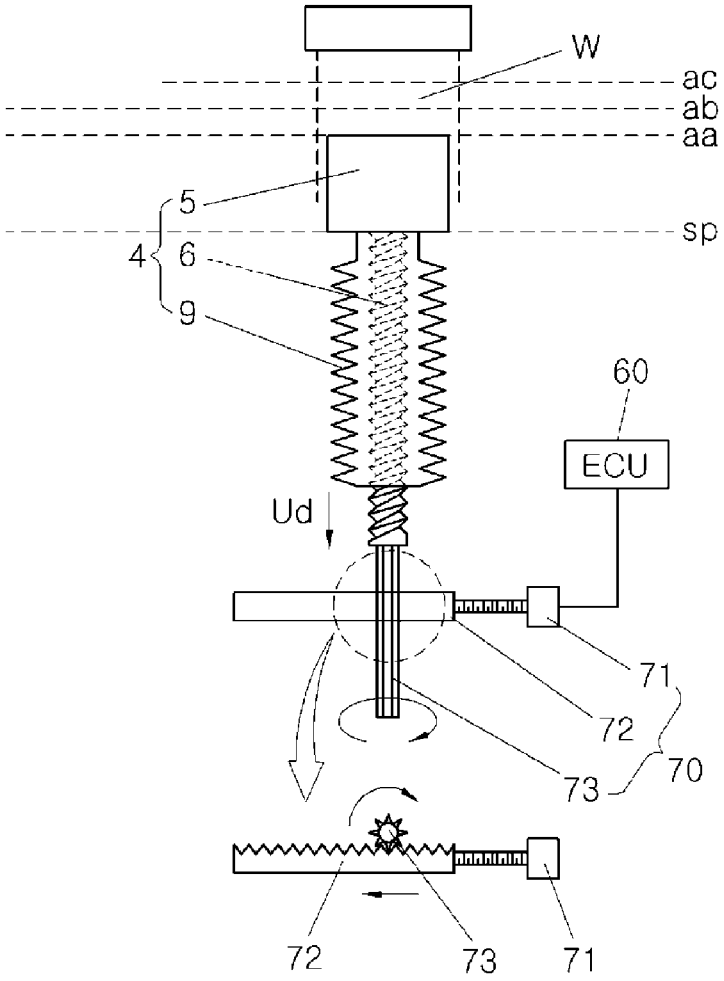
FIG. 7 is a compression ratio varying operation diagram using a compression varying unit according to another exemplary embodiment of the present invention.
Figure 7B:
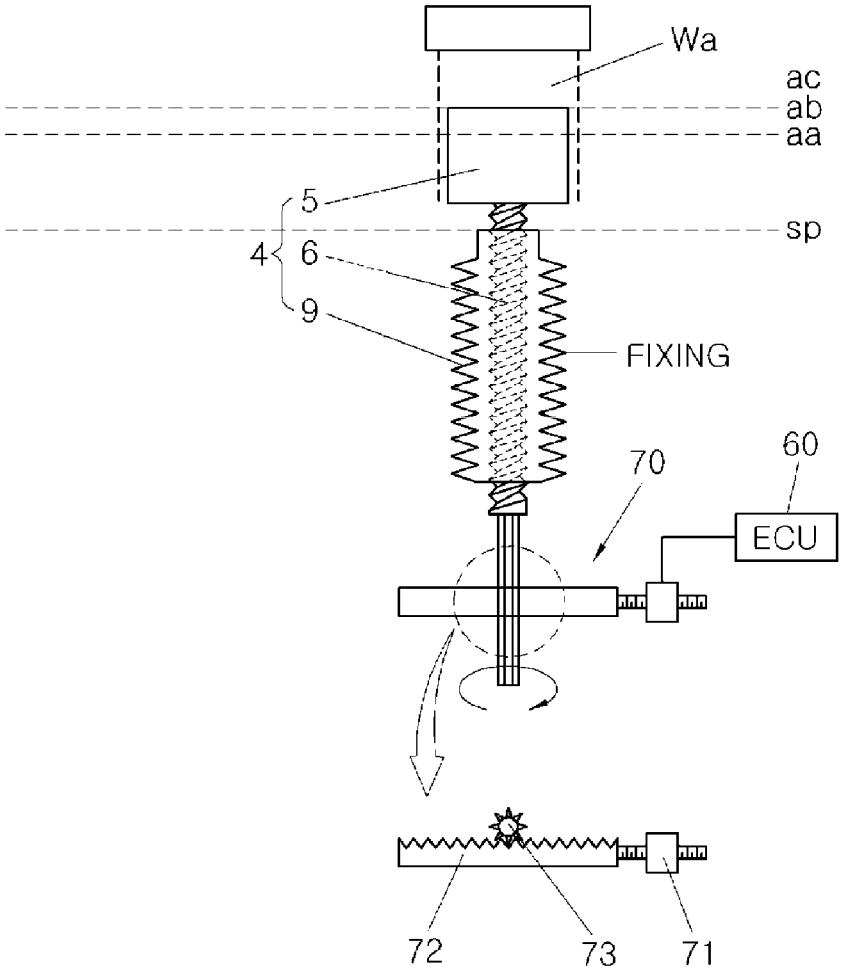
Figure 7C:
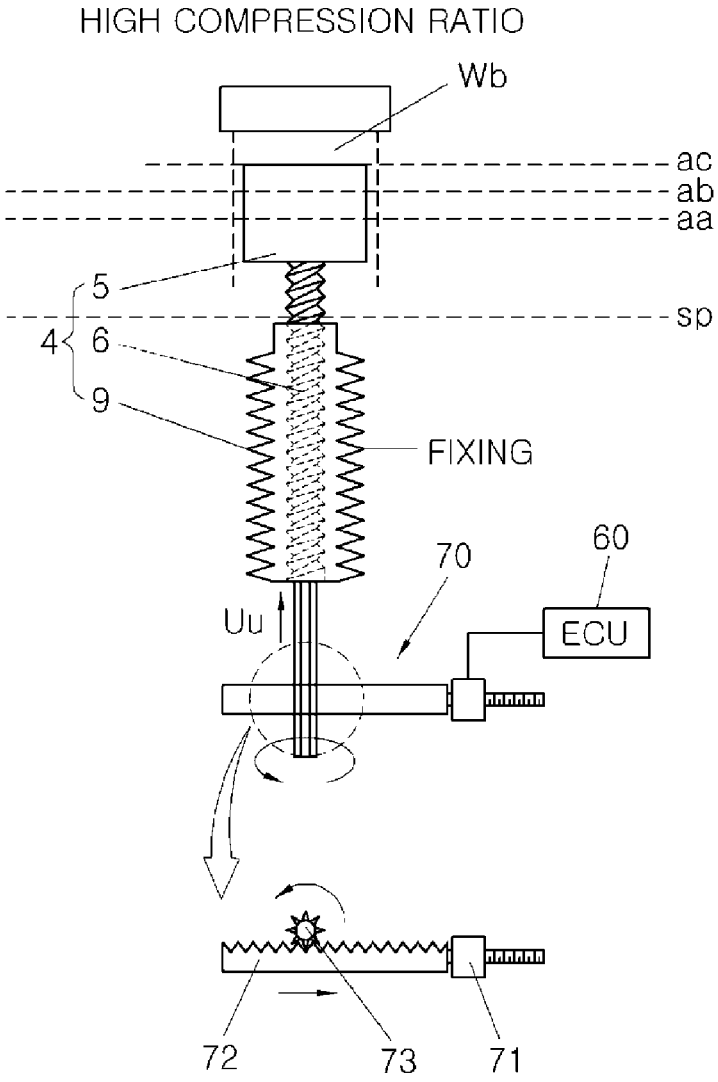

Meanwhile, FIG. 7B shows a state where the activated cylinder operates in a medium compression ratio Wa and FIG. 7A shows a state where the activated cylinder operates in a low compression ratio W, while FIG. 7C shows a state where the activated cylinder operates in a high compression ratio Wb.

As shown in FIG. 7A, when the cylinder operates in low compression ratio W, ECU 60 outputs a signal for switching medium compression ratio Wa to low compression ratio W to operate switching power unit 71 and rack bar 72 is pushed out by the operation of switching power unit 71 to move (move to the left side of FIG. 7A).

The push-out movement of rack bar 72 is switched to clockwise rotation of pinion 73 that engages therewith and the clockwise rotation of pinion 73 rotates connecting rod 6 connected thereto together.

The clockwise rotation of connecting rod 6 is switched to downward movement Ud to move down due to relative movement with gear rod 9 fixed with engaging with first and second intergears 7 and 8 of engine block 1 such that the height of piston 5 coupled to connecting rod 6 is lowered.

As described above, the height of piston 5 decreases to increase the volume of the combustion chamber and the cylinder may operate in a combustion atmosphere different from the combustion atmosphere of medium compression ratio Wa of FIG. 7B due to the increase in volume of the combustion chamber.

On the contrary, as shown in FIG. 7C, when the cylinder operates in high compression ratio Wb, ECU 60 outputs a signal for switching medium compression ratio Wa to high compression ratio Wb to operate switching power unit 71 and rack bar 72 is pulled by the operation of switching power unit 71 to move (move to the right side of FIG. 7C).

The pulling movement of rack bar 72 is switched to counterclockwise rotation of pinion 73 that engages therewith and the counterclockwise rotation of pinion 73 rotates connecting rod 6 connected thereto together.

The counterclockwise rotation of connecting rod 6 is switched to upward movement Uu to move up due to relative movement with gear rod 9 fixed with engaging with first and second intergears 7 and 8 of engine block 1 to lift the height of piston 5 coupled to connecting rod 6.

As described above, the height of piston 5 increases to decrease the volume of the combustion chamber and the cylinder may operate in a combustion atmosphere different from the combustion atmosphere of medium compression ratio Wa of FIG. 7B due to the decrease in volume of the combustion chamber.

Therefore, when low compression ratio W, medium compression ratio Wa, and high compression ratio Wb are switched to each other as described above, combustion efficiency can be significantly increases and the fuel efficiency can be significantly improved as proved above.

As described above, the crankshaftless internal combustion engine according to the exemplary embodiment includes a power shaft unit 10 in which a transferring path of a power system is selected depending on a deactivated state and an activated state of a cylinder and a cylinder separator 30 separating a power system of the deactivated cylinder from power shaft unit 10 by control of an ECU 60, thereby improving fuel efficiency due to a uniform change in volume of a combustion chamber of the cylinder and increasing reduction in Nox of exhaust gas, and particularly, a plurality of cylinders are controlled in a variable cylinder scheme to further improve fuel efficiency and be optimal to even EM improvement.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A crankshaftless internal combustion engine, comprising:

an engine block having a plurality of cylinders each having a reciprocating power system and controlled in a deactivated state and an activated state, a cylinder head including a valve system for exhausting air as well as supplying fuel required in each cylinder, and an oil pan provided below the cylinder head;

a power shaft unit converting a power generated from a power system of an activated cylinder into an engine output and transferring the engine output to a transmission without transferring the engine output to a power system of a deactivated cylinder;

a cylinder separator controlled by an ECU operating the plurality of cylinders as the deactivated cylinder and the activated cylinder and controlled by the ECU to separate the power system of the deactivated cylinder from the power shaft unit; and a compression changing unit controlled by the ECU so as to vary a compression ratio of the activated cylinder in multistage.

2. The crankshaftless internal combustion engine as defined in claim 1, wherein the power systems of the activated and deactivated cylinders include:

a piston reciprocating in a combustion chamber of each cylinder so as to form a 4-stroke cycle;

a connecting rod connected to the piston and reciprocating together with the piston, wherein the connecting rod has a thread formed on an outer peripheral surface; and a gear rod having a groove of thread to be engaged with the thread of the connecting rod, wherein the gear rod is engaged to the power shaft unit to rotate the power shaft unit while moving together with the connecting rod.

3. The crankshaftless internal combustion engine as defined in claim 2, wherein the gear rod includes:

a pair of first and second fixation bosses formed at both sides thereof, and first and second intergears rotatably coupled to the first and second fixation bosses respectively, wherein the first and second intergears are meshed with inter gears formed in the engine block, wherein a vertical reciprocating movement of the gear rod is guided by the pair of first and second fixation bosses which engage with the respective first and second intergears that free rotates in the engine block, and wherein a gear is formed on the gear rod on different portions where the pair of first and second fixation bosses are not formed.

4. The crankshaftless internal combustion engine as defined in claim 3, wherein the power shaft unit includes:

a main power shaft converting a power converted by the gear rod moving together with the connecting rod of the activated cylinder into the engine output transferred to the transmission; and a sub power shaft preventing the power of the main power shaft from being transferred to the gear rod moving together with the connecting rod of the deactivated cylinder in association with the cylinder separator, while transferring the power converted by using the gear rod moving together with the connecting rod of the activated cylinder to the main power shaft.

5. The crankshaftless internal combustion engine as defined in claim 4, wherein the main power shaft and the sub power shaft are arranged perpendicularly to the connecting rod and a rotation of the main power shaft or the sub power shaft is generated in a unidirectional stroke of the connecting rod in a reciprocating stroke thereof.

6. The crankshaftless internal combustion engine as defined in claim 5, wherein the power shaft unit includes:

first semi gears formed to the main power shaft and second semi gears formed to the sub power shaft, the first and second semi gears being alternatively engaged with a gear of the gear rod.

7. The crankshaftless internal combustion engine as defined in claim 6, wherein the first and second semi gears have half portion thereof formed with a plurality of gear tooth and rotate with the same phase angle.

8. The crankshaftless internal combustion engine as defined in claim 4, wherein a switching gear is engaged to both an input gear connected to the sub power shaft and an output gear connected to the main power shaft.

9. The crankshaftless internal combustion engine as defined in claim 4, wherein the main power shaft has a flywheel at a connection portion of the transmission and an accessory configured by a timing gear together with a driving pulley of an electronic apparatus at an opposite side to the connection portion of the transmission.

10. The crankshaftless internal combustion engine as defined in claim 1, wherein the cylinder separator includes:

a moving fork of which a direction is switched according to a switching power unit having a relay switched by control by the ECU; and a moving gear slidably mounted on the sub power shaft and engaged to the moving fork so as to move on the sub power shaft according to an operation of the moving fork, wherein at least one of the second semi gears are mounted to the moving gear, and wherein the moving gear adds the engine output to the main power shaft of the power shaft unit transferring the engine output to the transmission, and wherein according to the operation of the moving fork, the moving fork moves the at least one second semi gear along the sub power shaft.

11. The crankshaftless internal combustion engine as defined in claim 10, wherein a pair of moving gears is configured to move at least two semi gears by one-time movement of a pair of moving forks.

12. The crankshaftless internal combustion engine as defined in claim 10, wherein the moving fork has a fork structure engaged with the at least one second semi gear and the moving gear to which the at least one second semi gear is mounted is a hub including a protruding portion that engages with the moving fork.

13. The crankshaftless internal combustion engine as defined in claim 12, wherein a pair of hubs are configured to move at least two semi gears by one-time movement and a pair of moving forks are configured to move the pair of hubs.

14. The crankshaftless internal combustion engine as defined in claim 12, wherein the hub is spline-coupled to the sub power shaft to move the at least one second semi gear.

15. The crankshaftless internal combustion engine as defined in claim 1, wherein the compression changing unit includes:

a switching power unit having a relay switched by control of the ECU;

a rack bar engaged to the switching power unit and linearly moving by a switching operation of the switching power unit; and a pinion fixed to the connecting rod and engaged to the rack bar, wherein the piston moves vertically while the pinion rotates the connecting rod by linear movement of the rack bar as to move the gear rod to vary a relative distance between the power shaft unit and the piston.

16. The crankshaftless internal combustion engine as defined in claim 15, wherein the pinion is integrally provided at an end portion of the connecting rod.

17. The crankshaftless internal combustion engine as defined in claim 15, wherein the compression changing unit is installed in the oil pan.

* * * * *